US006821701B2

(12) United States Patent
Nakashima

(10) Patent No.: US 6,821,701 B2
(45) Date of Patent: Nov. 23, 2004

(54) TONER AND IMAGE FORMING APPARATUS

(75) Inventor: Yoshihiro Nakashima, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 10/113,951

(22) Filed: Apr. 2, 2002

(65) Prior Publication Data

US 2003/0003386 A1 Jan. 2, 2003

(30) Foreign Application Priority Data

Apr. 3, 2001 (JP) ..... 2001-104720
Apr. 3, 2001 (JP) ..... 2001-104721
Apr. 3, 2001 (JP) ..... 2001-104722

(51) Int. Cl.[7] ..... G03G 9/10
(52) U.S. Cl. ..... 430/111.4; 430/108.6; 399/297
(58) Field of Search ..... 430/111.4, 108.6; 399/297

(56) References Cited

U.S. PATENT DOCUMENTS 5,023,161 A 6/1991 Kitabatake et al.
5,504,559 A 4/1996 Ojima et al.
6,006,060 A 12/1999 Sato
6,195,522 B1 * 2/2001 Sato ..... 399/274
6,295,437 B1 * 9/2001 Hodoshima et al. ..... 399/346
6,564,027 B2 * 5/2003 Haraguchi et al. ..... 399/174

FOREIGN PATENT DOCUMENTS

EP 0 618 510 A2 10/1994
EP 0 977 092 A2 2/2000

OTHER PUBLICATIONS

Database WPI, Section Ch, Week 198942 Derwent Publications Ltd., GB; AN 1989–306697 XP002244791 & JP 01 229266 A (Tomoegawa Paper) abstract.
Database WPI, Section Ch, Week 199515 Derwent Publications Ltd., GB; AN 1995–111504 XP002244792 & JP 07 036217 A (CANON) Feb. 7, 1995 abstract.
Database WPI, Section EI, Week 200113 Derwent Publications Ltd., GB; AN 2001–116204 XP002244793 & JP 2000 338771 a (MITA) Dec. 8, 2000 abstract.
Database WPI, Section EI, Week 200058 Derwent Publications Ltd., GB; AN 2000–604551 XP002244794 & JP 2000 206736 (Ricoh), Jul. 28, 2000 abstract.

* cited by examiner

*Primary Examiner*—John L Goodrow
(74) *Attorney, Agent, or Firm*—Sughrue Mion, PLLC

(57) ABSTRACT

A toner having a medium-resistance external additive, and an image forming apparatus which uses the toner. The medium-resistance external additive coating ratio of particles, of which mother particles have equivalent diameters smaller or larger than a diameter of a mother particle diameter, which is equal to the mean particle diameter of the toner, is set to be higher than a virtual reference curve in synchronous distribution of the particle diameters of synchronous medium-resistance external additive particles, relative to the diameters of mother particles. Further, the medium-resistance external additive coating ratios of particles in a range in which mother particles have diameters smaller than d1, and in a range in which mother particles have diameters larger than d2, are set to be higher than a virtual reference curve in synchronous distribution of the particle diameters of synchronous medium-resistance external additive particles relative to the diameters of mother particles.

14 Claims, 5 Drawing Sheets

TONER AND IMAGE FORMING APPARATUS

BACKGROUND OF THE INVENTION

The present invention relates to a toner in which a medium-resistance external additive is added to control the amount of charge and an image forming apparatus.

FIG. 1 is an illustration for explaining a conventional image forming apparatus with an intermediate transfer member. A rotary developing unit 1 comprises developing rollers of four colors: Y, M, C, K. The developing unit 1 turns to bring every one of the developing rollers in contact with the photoreceptor 2 for every rotation of a photoreceptor 2, just like a revolver. After the photoreceptor 2 is uniformly charged by a charging unit 3, images for the respective colors are exposed to light so as to form electrostatic latent images on the photoreceptor 2. The photoreceptor 2 comes in contact with the developing rollers Y, M, C, K to develop respective color images. Because of contact between the photoreceptor 2 and an intermediate transfer member 5, these color images are transferred to the intermediate transfer member 5 (primary transfer). Residual toner particles remaining on the photoreceptor after the transfer are removed by a cleaning unit 4. As the four color images are superposed on each other on the intermediate transfer member 5, a paper 8 is conveyed and a secondary transfer roller 7 is brought in contact with the paper 8. At this point, secondary transfer bias voltage is applied by a power source (not shown) so as to transfer the superposed color images to the paper 8 at once (secondary transfer). The secondary transfer roller 7 can swing to come in contact with the intermediate transfer member 5 in the direction of the double arrow. While color images are primary transferred and toned on the intermediate transfer member 5, the secondary transfer roller 7 is spaced apart form the intermediate transfer member 5. During the secondary transfer, the secondary transfer roller 7 is in contact with the intermediate transfer member 5 via the paper. Residual toner particles remaining on the intermediate transfer member 5 after the secondary transfer are removed by a cleaning unit 6.

Toners to be used in the image forming apparatus having the aforementioned structure have particle size distribution. The range of the particle size distribution depends on manufacturing conditions of the toner, so sometimes narrow (particles are regular in size) and sometimes broad (particles are irregular in size, i.e. there are particles of various sizes). In general, in case of a toner prepared by the pulverization method, the particle size distribution should be relatively broad. Classification can help to somewhat narrow the range of the particle size distribution. However, there is a limit from the technical point of view and increase in cost is inevitable. In case of a toner prepared by the polymerization method, the particle size distribution should be relatively narrow, but all particles can never be of the same size.

When such a toner having s particle size distribution is used, a phenomenon, called "selective consumption development", in which toner particles in a certain particle size range are consumed prior to other toner particles occurs. That is, in a developing unit 10 shown in FIG. 2, toner particles are conveyed from a toner container 11→a supply roller 12→a developing roller 13 in this order, and then charged to be developed. During this, the toner is regulated by a regulating blade 14 into a predetermined thickness. In case of a non-magnetic toner, the supply roller 12 rotates in a direction opposite to the rotational direction of the developing roller 13 and is in contact with the developing roller so as to rub the toner onto the surface of the developing roller to cause frictional electrification. In this manner, toner particles of the non-magnetic toner are supplied from the supply roller 12 to the developing roller 13. When there is a small amount of toner particles on the developing roller 13, for example, in case of supplying toner particles to the developing roller 13 for the first time or immediately after a solid image is developed, toner particles in the toner container 11 are supplied to the developing roller 13 without any selection. On the other hand, when there is a somewhat larger amount of toner particles on the developing roller 13, for example, after a white solid image or characters or lines with low density is developed, toner particles with diameters which are easily caught by the developing roller 13 stay on the developing roller 13 and toner particles with diameters which are hardly caught by the developing roller 13 come off the developing roller 13 and are thus collected in the developing unit, depending on the roughness of the developing roller, the conditions of regulation, and the conditions of supply.

Since most of outputs of image forming apparatuses are low density images such as characters and lines just like the latter case, such toner particles with diameters which are easily caught by the developing roller are consumed prior to the other toner particles. Toner particles to be easily caught by the developing roller depend on the conditions such as the roughness of the developing roller. Originally, these conditions are set to facilitate that toner particles with diameters equal or close to the mean particle diameter exhibit their performance. Therefore, toner particles with diameters equal or close to the mean particle diameter or in a range about the roughness of the developing roller are consumed prior to the other toner particles. This phenomenon is called "selective consumption development".

FIG. 3 is a graph showing a particle size distribution of toner particles which remain in the developing unit due to the selective consumption development. In this graph, the original particle size distribution is indicated by D. Toner particles with diameters to be consumed due to the selective consumption development are the most abundant particles. When the residual quantity of the toner is reduced by repeated consumption, the ratio of toner particles of other diameters smaller or larger than the mean particle diameter or than the roughness of the developing roller is increased. As toner is refilled, toner particles with diameters easily consumed are consumed prior to the other toner particles so as to increase the concentration of the other toner particles, resulting in a distribution indicated by D'.

When the quantity of toner particles not suitable for developing is increased in the developing unit because the residual quantity of toner is reduced and the toner is repeatedly refilled, toner particles with small diameters and large diameters which are not suitable for developing must be consumed for developing. In this case, since the amount of charge on toner particles with small diameters is high relative to the mass thereof, these are hardly developed because of the mirror-image force of the charge so as to stay on the developing roller. Therefore, the small toner particles may be damaged by friction of the regulating blade and the like so that these are easily adhered to the developing roller and the like, thereby leading to the occurrence of filming. On the other hand, since the amount of charge on toner particles with large diameters is low relative to the mass thereof, these are easily conveyed by developing filed and thus easily developed. However, in case of using large toner particles, flush or interruption may be produced in the transfer process, thus degrading a resultant image.

To prevent the aforementioned problems due to the selective consumption development, there is a method of agitating toner particles in the developing unit. However, the selective consumption of toner particles is caused by outputs of images and thus dependent on image patterns, Due to repeat printing with insufficient agitation, undesired concentration of toner particles is partially caused. By fully agitating the toner particles to provide a uniform concentration, the progress of undesired concentration can be slowed. However, this method is just slowing the concentration due to the selective consumption, and is not a radical measure.

There is another method of peeling toner particles from the developing roller during every rotation. For example, when the supply roller is in contact with the developing roller with increased pressure, the toner particles are peeled from the developing roller during every rotation. Therefore, the state on the developing roller should be just like the state after a solid image is outputted so that the toner particles are uniformly consumed regardless of the particle size. Since this method leads to large torque-up and toner damage, however, preventative measures are necessary for practical use of this method.

SUMMARY OF THE INVENTION

The present invention is made in order to solve the aforementioned problems. In the present invention, the medium-resistance external additive coating ratio of toner particles of which charge is to be leaked is changed according to the diameter of toner particles, thereby making the charge-to-mass ratio constant and preventing the occurrence of selective consumption development.

Therefore, the first aspect of the present invention is a toner being characterized in that the medium-resistance external additive coating ratio of toner particles of which mother particles have equivalent particle diameters smaller than an equivalent particle diameter of a mother particle diameter equal to the mean particle diameter of the toner is set to be higher than a virtual reference curve in synchronous distribution of the equivalent particle diameters of synchronous medium-resistance external additive particles relative to the equivalent particle diameters of mother particles, wherein assuming that the medium-resistance external additive coating ratio of a toner particle of which a mother particle has an equivalent particle diameter equal to the roughness of a developing roller or the mean particle diameter of the toner is a reference value, the virtual reference curve is obtained to satisfy that the medium-resistance external additive coating ratio is constant at the reference value.

The second aspect of the present invention is a toner being characterized in that the medium-resistance external additive coating ratios of toner particles in a range in which mother particles have equivalent particle diameters smaller than d1 and in a range in which mother particles have equivalent particle diameters larger than d2 are set to be higher than a virtual reference curve in synchronous distribution of the equivalent particle diameters of synchronous medium-resistance external additive particles relative to the equivalent particle diameters of mother particles, wherein assuming that the medium-resistance external additive coating ratio of a toner particle with a diameter between d1 and d2 is a reference value wherein d1 is an equivalent particle diameter of a mother particle equal to the roughness of the developing roller and d2 is an equivalent particle diameter of a mother particle equal to the mean particle diameter of the toner (d1<d2), the virtual reference curve is obtained to satisfy that the medium-resistance external additive coating ratio is constant at the reference value.

The third aspect of the present invention is a toner being characterized in that the medium-resistance external additive coating ratio of toner particles in a range in which mother particles have equivalent particle diameters larger than the roughness of the developing roller or than an equivalent particle diameter of a mother particle equal to the mean particle diameter of the toner is set to be higher than a virtual reference curve in synchronous distribution of the equivalent particle diameters of synchronous medium-resistance external additive particles relative to the equivalent particle diameters of mother particles, wherein assuming that the medium-resistance external additive coating ratio of a toner particle of which a mother particle has an equivalent particle diameter equal to the roughness of a developing roller or the mean particle diameter of the toner is a reference value, the virtual reference curve is obtained to satisfy that the medium-resistance external additive coating ratio is constant at the reference value.

The fourth aspect of the present invention is an image forming apparatus comprising a photoreceptor on which an electrostatic latent image is formed, a developing unit for developing the electrostatic latent image on the photoreceptor with a toner, a transfer means for transferring the developed image on the photoreceptor, and a fusing means for fusing the transferred image, the image forming apparatus being characterized that said toner is a toner of any one of the aforementioned aspects.

DESCRIPTION OF THE PREFERRED EMBODIMENTS

First, the particle diameter of each equivalent particle used in each aspect of the present invention will be described.

For analyzing toner particles according to the particle analyzing method, toner particles are introduced into plasma, thereby exciting the toner particles to emit light. The toner particles are composed of mother particles made of resin (carbon) such as polyester, and titanium oxide ($TiO_2$)

or a mixture of titanium oxide and silica (silicon oxide) as an external additive which coats the mother particles to improve the fluidity and the charging property. During light emission of the toner, the emission spectrum (frequency) peculiar to its elements and the intensity of emitted light depending on the number of atoms of its elements are obtained. From the measured values of the emission frequency and the intensity, the number of atoms (mass) of the elements composing the mother particles and the external additive particles can be given. For analysis, the mass of elements composing the mother particles and the mass of elements composing the external additives can be converted to perfect spheres, respectively. The perfect spheres are called equivalent particles, and the particle diameter of each equivalent particle is called an equivalent particle diameter which can be expressed as cubic-root voltage of the signal intensity of emission spectrum (proportional to the mass) to be measured (Japanese Patent Unexamined Publication H12-47425).

Figure 4:
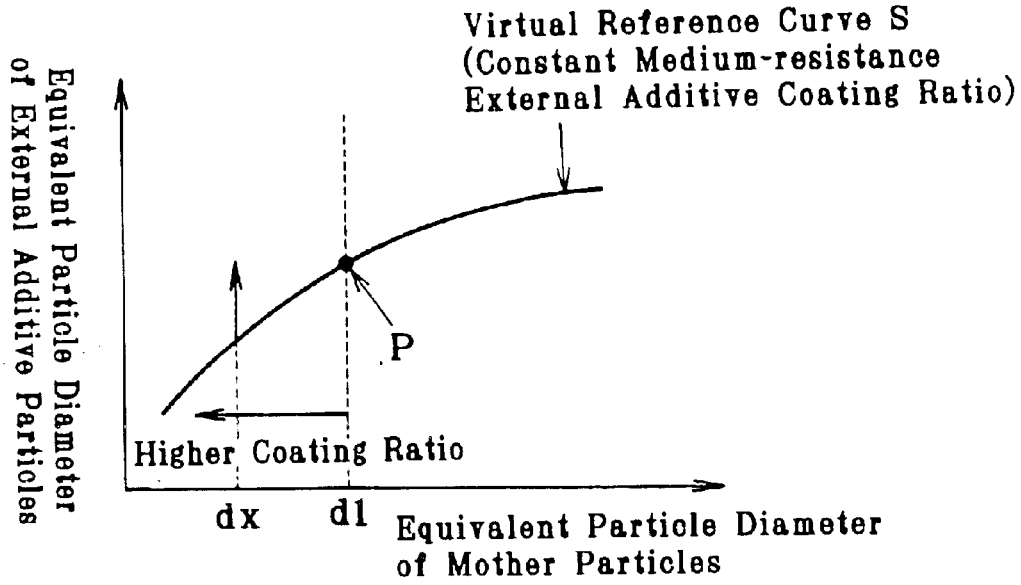
FIG. 4 is a graph for explaining a synchronous distribution curve defining a toner of the first aspect of the invention.

According to the particle analyzing method, the toner in which the mother particles and the external additive particles adhere to each other is called as a toner in synchronized state (synchronous toner particles) because the light emission of the mother particles and the light emission of the external additive particles are detected simultaneously. The toner in which the mother particles and the external additive particles are liberated from each other is called as a toner in the non-synchronized state (asynchronous toner particles) the light emission of the mother particles and the light emission of the external additive particles are detected at different times. Plotted on the abscissa and the ordinate of FIG. 4 are asynchronous toner particles. Asynchronous mother particles are plotted on the abscissa and asynchronous external additive particles are plotted on the ordinate. Plotted on any other points are synchronous toner particles. The plotting position is defined by a ratio of the amount of mother particles and the amount of external additive particles.

When external additive particles are uniformly distributed inside (entrapped in) the mother particles, the synchronous distribution is represented by a straight line because the amount of the mother particles and the amount of the additive particles are both proportional to the cube of the particle diameters (their particle diameters). When external additive particles adhere to only the surfaces of mother particles, the synchronous distribution is represented by a curve of the (⅔) power because the amount of the mother particles is proportional to the cube of the particle diameter and the amount of the external additive particles is proportional to the surface area, i.e. the square of the particle diameter, of the mother particles. Therefore, when the external additive coating rate on the surface of any mother particle is constant, the synchronous distribution is represented by a curve of the (⅔) power just like a virtual reference curve S in FIG. 4. Assuming that external additive particles are added into the toner by a constant rate, as the ratio of liberated external additive particles increases, the ratio of synchronous external additive particles decreases so that the slope of the synchronous distribution curve decreases. On the other hand, as the ratio of liberated external additive particles decreases, the ratio of synchronous external additive particles increases so that the slope of the synchronous distribution curve increases. In this manner, the adhering state of external additive particles to mother particles can be analyzed.

In the following aspects of the invention, a medium-resistance external additive is employed as an external additive for coating, to control the charge-to-mass ratio of toner particles to be constant, thereby preventing the occurrence of the selective consumption development.

The material of the medium-resistance external additive to be employed may be titanium oxide ($TiO_2$) or a mixture of titanium oxide and silicon oxide ($TiO_2$+$SiO_2$), with a resistance value in a range from $10^8$ Ω cm to $10^{12}$ Ω cm. The medium-resistance external additive is used for controlling the charge distribution of the toner in order to prevent the fogging and improve the developing property. In case of using an external additive with a resistance value less than $10^8$ Ω cm, the charging property of the toner is significantly reduced so as to cause the fogging and the scatter of toner powder. In case of using an external additive with a resistance value exceeding $10^{12}$ Ω cm, the charge distribution of the toner should be broad so as to cause the fogging due to toner particles of a reversed polarity.

The medium-resistance external additives are added to toner particles by using a mixing machine, such as a V-type blender, a Henchel mixer, or a Loedige mixer. A vibrating screen or an air classifier may be used for removing bulky particles of toner. For selectively changing the adding amount of external additives according to the diameter of the toner particles, the toner particles are classified into several groups according to the particle diameter. The process of adding external additive particles is conducted for each group and after that, these groups are blended. In this manner, the different coating ratios according to the particle diameters can be achieved.

FIG. 4 is a graph for explaining a synchronous distribution curve for defining a synchronous toner indicating the ratio of the amount of mother particles and the amount of medium-reference external additive particles adhering to the mother particles in a toner of the first aspect of the invention. The abscissa stands for the equivalent particle diameter of the mother particles and the ordinate stands for the equivalent particle diameter of the external additive particles.

A toner of the first aspect of the present invention will now be described. In FIG. 4, it is assumed that the medium-resistance external additive coating ratio of a toner particle of which a mother particle has an equivalent particle diameter equal to the roughness (the size of concavities) of the developing roller or the mean particle diameter of the toner is a reference value (80–120%). A virtual reference curve S passing through a reference point P is plotted to satisfy that the external additive coating ratio is constant at the reference value. The toner is prepared in such a manner that the medium-resistance external additive coating ratio of toner particles within a range in that mother particles have equivalent particle diameters smaller than the roughness of the developing roller or the mean particle diameter of the toner is set to be higher than the virtual reference curve S.

The medium-resistance external additive such as titanium oxide are added in such a manner that the medium-resistance external additive coating ratio of toner particles within the range of dx in which mother particles have equivalent particle diameters smaller than the equivalent particle diameter d1 of a mother particle corresponding to the roughness of the developing roller or the mean particle diameter is set to be higher than the reference curve in FIG. 4, thereby leaking some charge of the small toner particles. As a result, the charge-to-mass ratio of the small toner particles becomes equal or close to that of other toner particles, thereby improving the developing property.

Figure 1:
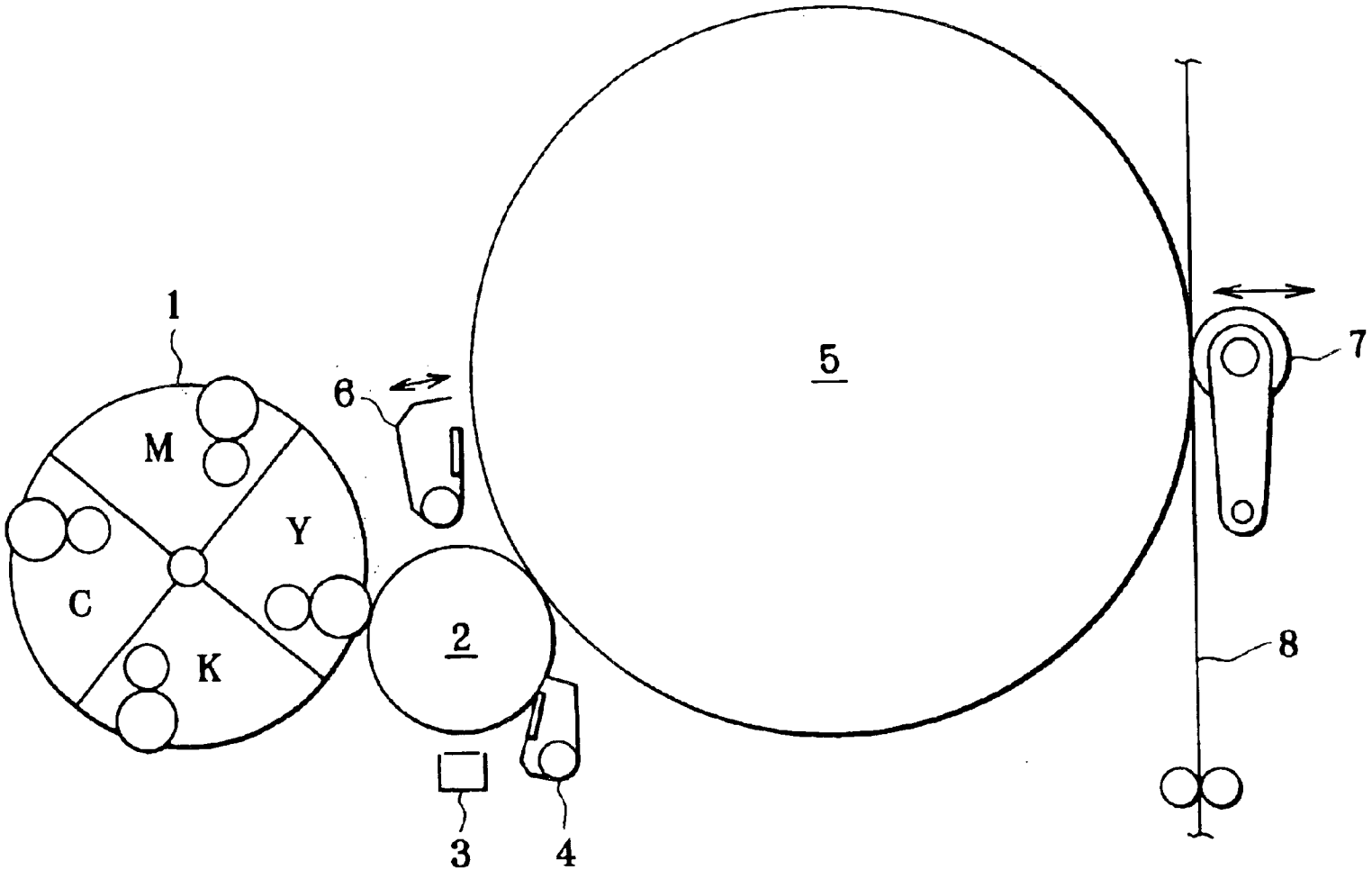
FIG. 1 is an illustration for explaining an image forming apparatus.
Figure 2:
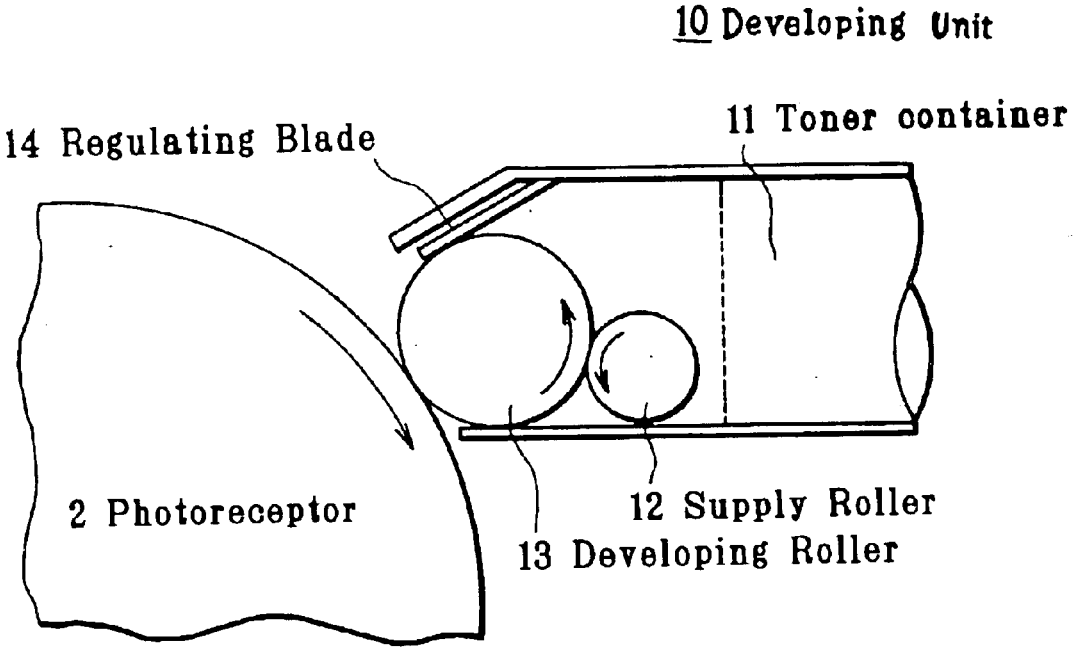
FIG. 2 is an illustration for explaining a developing unit.
Figure 3:
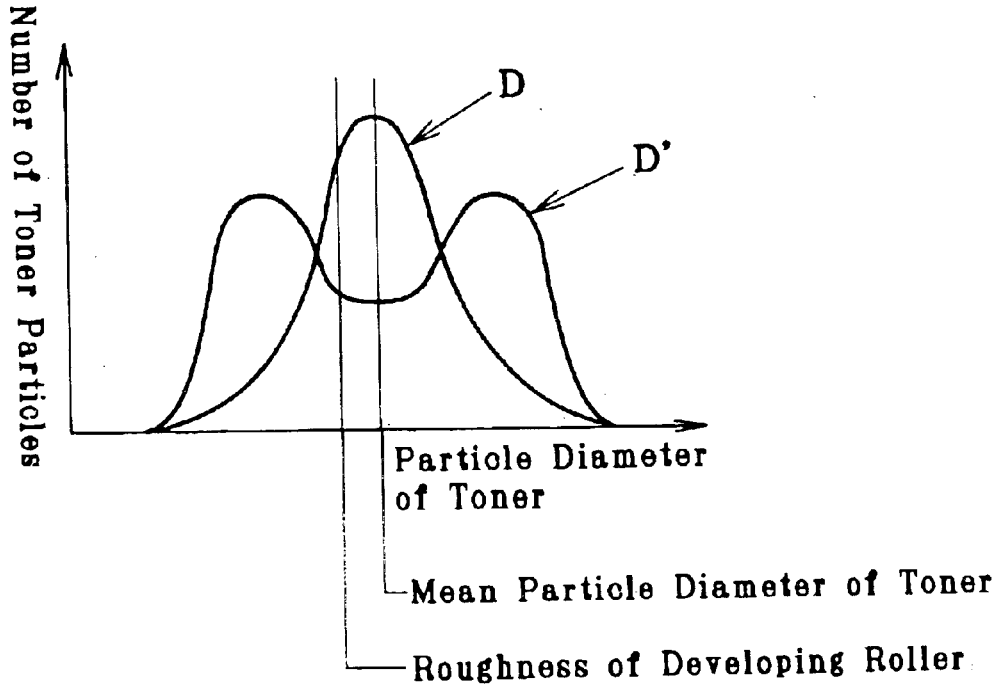
FIG. 3 is an illustration for explaining the selective consumption development.
Figure 5:
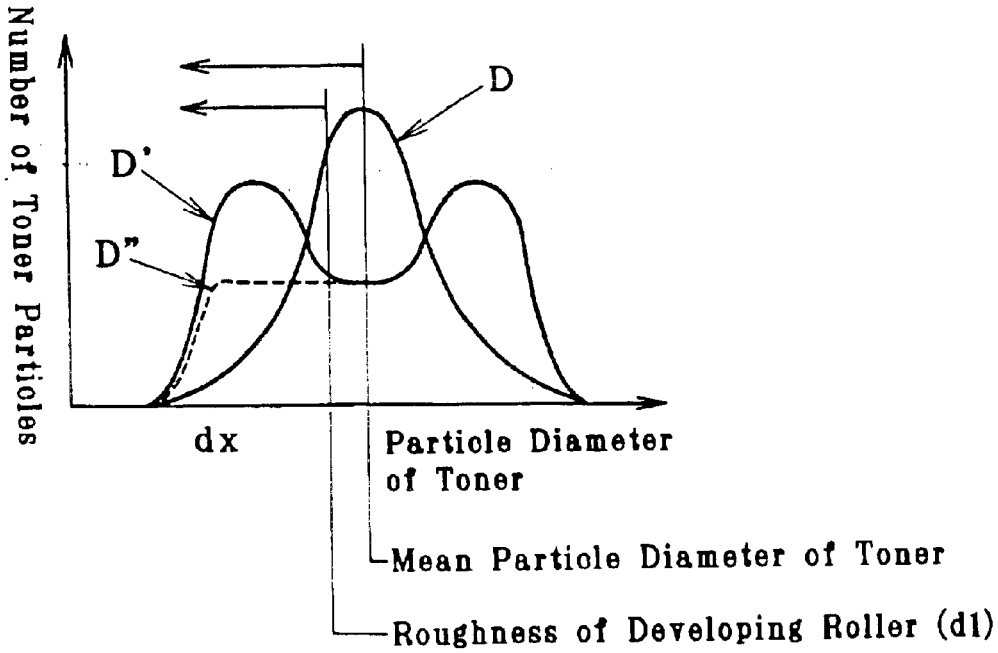
FIG. 5 is an illustration for explaining the prevention of the selective consumption development in a range of small particle size.

FIG. 5 is a similar graph as FIG. 3 showing particle size distribution. In the first aspect of the invention, the charge-to-mass ratio in the range of dx (dx<d1) is improved so that the toner particles in this range become easy to be developed. Therefore, the toner particles in this range can be consumed similarly to the toner particles in a range equal or close to the mean particle diameter or equal or close to the roughness of the developing roller as shown by a distribution curve of dotted line indicated by D", thereby preventing the toner particles in this range from not being consumed due to the selective consumption development.

As described above, according to the first aspect of the invention, the medium-resistance external additive coating ratio of toner particles within a range in which mother particles have equivalent particle diameters smaller than the roughness of the developing roller or the mean particle diameter of the toner is set to be higher than a virtual reference curve, wherein assuming that the medium-resistance external additive coating ratio of a toner particle of which a mother particle has an equivalent particle diameter equal to the roughness of the developing roller or the mean particle diameter of the toner is a reference value, the virtual reference curve is obtained to satisfy that the medium-resistance external additive coating ratio is constant at the reference value, thereby improving the charge-to-mass ratio of the toner particles in the small particle diameter range and thus preventing the occurrence of the selective consumption development.

Figure 6:
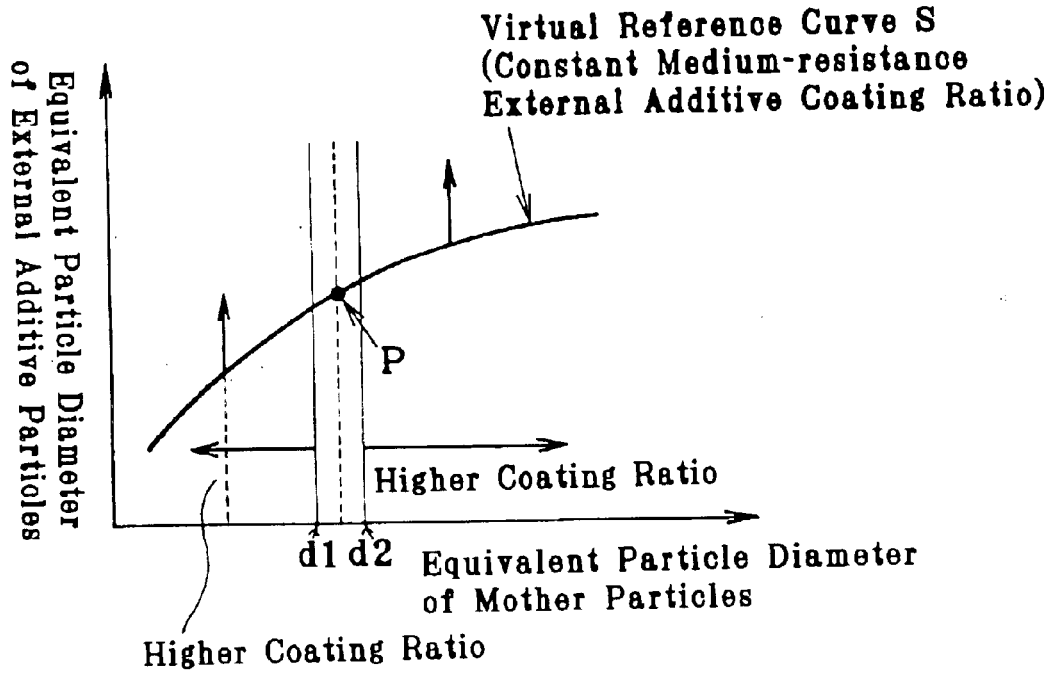
FIG. 6 is a graph for explaining a synchronous distribution curve defining a toner of the second aspect of the invention.

FIG. 6 is a graph for explaining a synchronous distribution curve for defining a synchronous toner indicating the ratio of the amount of mother particles and the amount of medium-reference external additive particles adhering to the mother particles in a toner of the second aspect of the invention. The abscissa stands for the equivalent particle diameter of the mother particles and the ordinate stands for the equivalent particle diameter of the external additive particles.

A toner of the second aspect of the present invention will now be described. In FIG. 6, it is assumed that the medium-resistance external additive coating ratio of a toner particle with a diameter between d1 and d2 is a reference value (80–120%) wherein d1 is an equivalent particle diameter of a mother particle equal to the roughness of the developing roller (about 5 $\mu$m) and d2 is the mean particle diameter of the toner (normally from 7 $\mu$m to 8 $\mu$m). A virtual reference curve S passing through a reference point P is plotted to satisfy that the external additive coating ratio is constant at the reference value. The toner is prepared in such a manner that the medium-resistance external additive coating ratios of toner particles within a range in which mother particles have equivalent particle diameters smaller than d1 (hereinafter, the range smaller than d1) and within a range in which mother particles have equivalent particle diameters larger then d2 (hereinafter, the range larger than d2) are set to be higher than the virtual reference curve S.

The medium-resistance external additive such as titanium oxide are added in such a manner that the medium-resistance external additive coating ratios of toner particles in the range smaller than d1 and in the range larger than d2 is set to be higher than the reference curve S in FIG. 6. The toner particles in the range between d1 and d2 are toner particles originally well used for developing. The medium-resistance external additive coating ratios of toner particles other than the toner particles in the range between d1 and d2 are set to be higher, thereby leaking some charge of the other toner particles. As a result, the charge-to-mass ratios of the other toner particles become equal or close to that of the toner particles in the range between d1 and d2, thereby improving the developing property.

Figure 7:
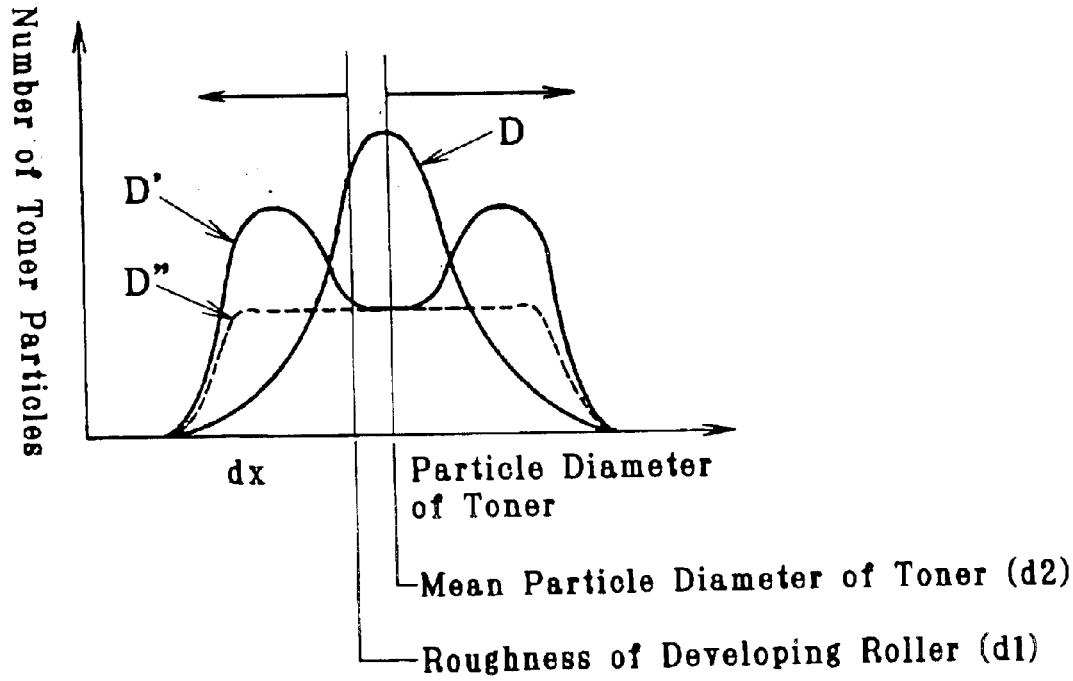
FIG. 7 is an illustration for explaining the prevention of the selective consumption development in ranges of small particle size and large particle size.

FIG. 7 is a similar graph as FIG. 3 showing particle size distribution. In the second aspect of the invention, the charge-to-mass ratios in the range smaller than d1 and in the range larger than d2 are improved so that the toner particles in these ranges become easy to be developed. Therefore, the toner particles in these ranges can be consumed similarly to the toner particles in a particle diameter range equal or close to the mean particle diameter or the roughness of the developing roller as shown by a distribution curve of dotted line indicated by D", thereby preventing the toner particles in these ranges from not being consumed due to the selective consumption development.

As described above, according to the second aspect of the invention, the medium-resistance external additive coating ratios of toner particles in a range in which mother particles have equivalent particle diameters smaller than d1 and in a range in which mother particles have equivalent particle diameters larger than d2 are set to be higher than a virtual reference curve, wherein assuming that the medium-resistance external additive coating ratio of a toner particle with a diameter between d1 and d2 is a reference value wherein d1 is an equivalent particle diameter of a mother particle equal to the roughness of the developing roller and d2 is the mean particle diameter of the toner (d1<d2), the virtual reference curve is obtained to satisfy that the medium-resistance external additive coating ratio is constant at the reference value, thereby making the charge-to-mass ratios constant and thus preventing the occurrence of the selective consumption development.

Figure 8:
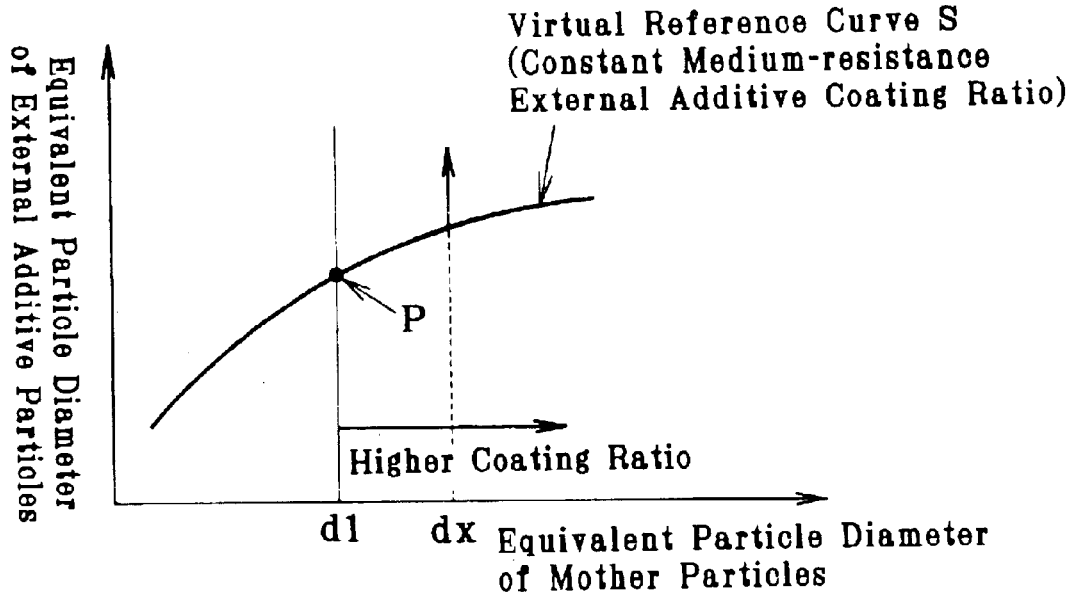
FIG. 8 is a graph for explaining synchronous distribution curve defining a toner of the third aspect of the invention.

FIG. 8 is a graph for explaining a synchronous distribution curve for defining a synchronous toner indicating the ratio of the amount of mother particles and the amount of medium-reference external additive particles adhering to the mother particles in a toner of the third aspect of the invention. The abscissa stands for the equivalent particle diameter of the mother particles and the ordinate stands for the equivalent particle diameter of the external additive particles.

A toner of the third aspect of the present invention will now be described. In FIG. 8, it is assumed that the medium-resistance external additive coating ratio of a toner particle of which a mother particle has an equivalent particle diameter equal to the roughness (the size of concavities) of the developing roller or the mean particle diameter of the toner is a reference value (80–120%). A virtual reference curve S passing through a reference point P is plotted to satisfy that the external additive coating ratio is constant at the reference value. The toner is prepared in such a manner that the medium-resistance external additive coating ratio of toner particles in such a range that mother particles have equivalent particle diameters larger than the roughness of the developing roller or the mean particle diameter of the toner is set to be higher than the virtual reference curve S.

The medium-resistance external additive such as titanium oxide are added in such a manner that the medium-resistance external additive coating ratio of toner particles within the range of dx in which mother particles have equivalent particle diameters larger than the equivalent particle diameter d1 of a mother particle corresponding to the roughness of the developing roller or the mean particle diameter is set to be higher than the reference curve in FIG. 8, thereby leaking some charge of the small toner particles. As a result, the charge-to-mass ratio of the larger toner particles becomes equal or close to that of other toner particles, thereby improving the developing property.

Figure 9:
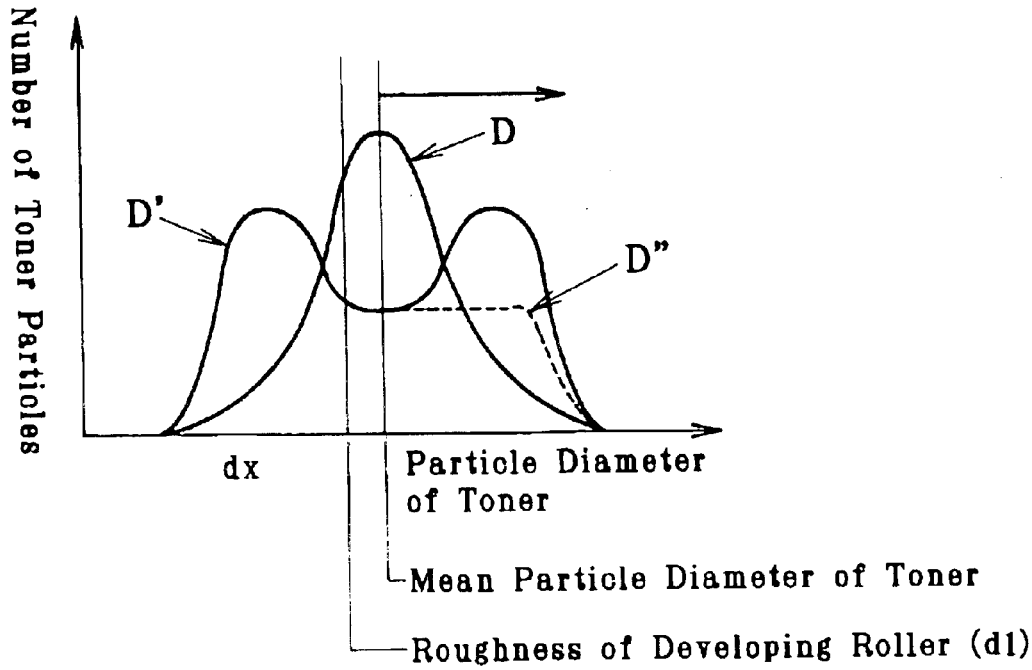
FIG. 9 is an illustration for explaining the prevention of the selective consumption development in a range of large particle size.

FIG. 9 is a similar graph as FIG. 3 showing particle size distribution. In the third aspect of the invention, the charge-to-mass ratio in the range of dx (dx>d1) is improved so that the toner particles in this range become easy to be developed. Therefore, the toner particles in this range can be consumed similarly to the toner particles in a range equal or close to the mean particle diameter or the roughness of the developing roller as shown by a distribution curve of dotted line indicated by D", thereby preventing the toner particles in this range from not being consumed due to the selective consumption development.

As described above, according to the third aspect of the invention, the medium-resistance external additive coating ratio of toner particles within a range in which mother particles have equivalent particle diameters larger than the roughness of the developing roller or the mean particle diameter of the toner is set to be higher than a virtual reference curve, wherein assuming that the medium-resistance external additive coating ratio of a toner particle of which a mother particle has an equivalent particle diameter equal to the roughness of the developing roller or the mean particle diameter of the toner is a reference value, the virtual reference curve is obtained to satisfy that the medium-resistance external additive coating ratio is constant at the reference value, thereby improving the charge-to-mass ratio of the toner particles in the larger particle diameter range and thus preventing the occurrence of the selective consumption development.

It should be noted that the toners of the aforementioned aspects of the invention may be of a negative polarity or of a positive polarity. The mother particles comprises at least a base resin forming the toner, a charge controlling agent for controlling the amount of charge, a pigment, an external additive, a releasing agent, a magnetic material, and other additives.

The material for the mother particles may be selected from a group consisting of: polystyrene and copolymers thereof, for example, hydrogenated styrene resin, styrene-isobutyrene copolymer, ABS resin, ASA resin, AS resin, AAS resin, ACS resin, AES resin, styrene-P-chlorostyrene copolymer, styrene-propylene copolymer, styrene-butadiene crosslinked polymer, styrene-butadiene-chlorinated paraffin copolymer, styrene-allyl-alcohol copolymer, styrene-butadiene rubber emulsion, styrene ester maleate copolymer, styrene-isobutylene copolymer, and styrene-maleic anhydride copolymer; acrylate resins and methacrylate resins and their copolymers; styrene-acrylic resins and their copolymers, for example, styrene-acryl copolymer, styrene-diethylamino-ethylmethacrylate copolymer, styrene-butadiene-acrylic ester copolymer, styrene-methylmethacrylate copolymer, styrene-n-butylacrylate copolymer, styrene-methylmethacrylate-n-butylmethacrylate copolymer, styrene-methylmethacrylate-butylarylate-N-(ethoxymethyl) acrylamide copolymer, styrene-glycidylmethacrylate copolymer, styrene-butadiene-dimethyl-aminoethylmethacrylate copolymer, styrene ester acrylic ester maleate copolymer, styrene-methyl methacrylate-acrylic acid-2-ethylhexyl copolymer, styrene-n-butylarylate-ethylglycolmethacrylate copolymer, styrene-n-butylmethacrylate-acrylic acid copolymer, styrene-n-butylmethacrylate-maleic anhydride copolymer, styrene-butyl acrylate-isobutyl maleate half ester-divinylbenzene copolymer; polyesters and copolymers thereof; polyethylene and copolymers thereof; epoxy resins; silicone resins; propylene and copolymers thereof; fluororesins; polyamide resins; polyvinyl alcohol resins; polyurethane resins; and polyvinylbutyral resin. Any one of the foregoing materials may be employed singly or a blend of any two or more materials may be employed.

The coloring agent may be carbon black, spirit black, nigrosine, rhodamine dyes, triaminotriphenylmethane, cation dyes, dioxazine, copper phthalocyanine, perylene, azo dyes, auriferous azo pigment, azochrome complex, carmine dyes, benzidine dyes, solar pure yellow 8G, quinacridon, polytungstophosphate, Indanthrene Blue, sulfonamide derivative or the like.

The charge controlling agent may be an electron-acceptable organic complex, chlorinated polyester, nitrohumic acid, quaternary ammonium salt, or pyridinium salt. The releasing agent may be polypropylene wax, polyethylene wax, or the like. The dispersant may be metallic soap, polyethylene glycol or the like. Other additives may be zinc stearate, zinc oxide, cerium oxide or the like.

Furthermore, the magnetic material may be metal powder of Fe, Co, Ni, Cr, Mn or Zn; metal oxide, such as $Fe_3O_4$, $Fe_2O_3$, $Cr_2O_3$ or ferrite; an alloy, such as an alloy containing manganese and acid, which is provided with a ferromagnetic characteristic by heat treatment; or the like and may be previously treated by using a coupling material. The foregoing materials are formed into the mother particles by a usual kneading pulverization method, a spray and dry method, or a polymerizing method.

On the other hand, the external additive may be inorganic fine particles of metal oxide, such as silica, alumina, and titanium oxide, or their composite oxide; or organic fine particles, for example, acryl fine particles. As its surface treatment material, a silane coupling agent, a titanate coupling agent, a fluorine-contained silane coupling agent, or silicone oil may be employed. It is preferable that the hydrophobic ratio of the external additive processed with the foregoing processing agent is 60% or higher when the ratio is measured by a conventional methanol method. If the ratio is lower than this value, deterioration in the electrification characteristic and fluidity easily occurs in a hot and wet environment owning to adsorption of water. It is preferable that the particle diameter of the external additive is 0.001 $\mu$m to 1 $\mu$m from a viewpoint of improving the transporting property and the charging property. It is preferable that the adding amount of the external additive is 0.1 wt % to 5 wt % relative to the mother particles of toner. If the amount is larger than this value, the possibility of making external additive particles asynchronous with mother particles of toner is raised. Thus, secondary coagulation of external additive particles frequently occurs, causing determination in the electrification characteristic and increase in the number of linear stains.

The external additive is not limited to only one kind and may be prepared by mixing two or more kinds of additives. The toners of the respective aspects of the invention can be prepared by mixing the mother particles and the external additive particles in a dry state so as to adhere to one another by using a high-speed fluidization mixing machine, such as a Henschel mixer or Perpen mayer or a mixing machine using a mechanochemical method.

The fourth aspect of the present invention is an image forming apparatus comprising a photoreceptor on which an electrostatic latent image is formed, a developing unit for developing the electrostatic latent image on the photoreceptor with a toner, a transfer means for transferring the developed image on the photoreceptor, and a fusing means for fusing the transferred image, the image forming apparatus being characterized in that said toner is a toner of any one of the aforementioned aspects. The image forming apparatus using the toner of the invention is not limited to an image forming apparatus having an intermediate transfer member and may be an image forming apparatus in which an image on a photoreceptor is directly transferred to a paper and the transferred image is fused.

I claim:

1. A toner being characterized in that the medium-resistance external additive coating ratio of toner particles of which mother particles have equivalent particle diameters smaller than an equivalent particle diameter of a mother particle diameter equal to the roughness of a developing roller or the mean particle diameter of the toner is set to be higher than a virtual reference curve in synchronous distribution of the equivalent particle diameters of synchronous medium-resistance external additive particles relative to the equivalent particle diameters of mother particles, wherein assuming that the medium-resistance external additive coating ratio of a toner particle of which a mother particle has an equivalent particle diameter equal to the roughness of a developing roller or the mean particle diameter of the toner is a reference value, the virtual reference curve is obtained to satisfy that the medium-resistance external additive coating ratio is constant at the reference value.

2. A toner as claimed in claim 1, being characterized in that said reference value is in a range from 80% to 120%.

3. A toner being characterized in that the medium-resistance external additive coating ratios of toner particles in a range in which mother particles have equivalent particle diameters smaller than d1 and in a range in which mother particles have equivalent particle diameters larger than d2 are set to be higher than a virtual reference curve in synchronous distribution of the equivalent particle diameters of synchronous medium-resistance external additive particles relative to the equivalent particle diameters of mother particles, wherein assuming that the medium-resistance external additive coating ratio of a toner particle with a diameter between d1 and d2 is a reference value wherein d1 is an equivalent particle diameter of a mother particle equal to the roughness of the developing roller and d2 is an equivalent particle diameter of a mother particle equal to the mean particle diameter of the toner (d1<d2), the virtual reference curve is obtained to satisfy that the medium-resistance external additive coating ratio is constant at the reference value.

4. A toner as claimed in claim 3, being characterized in that said reference value is in a range from 80% to 120%.

5. A toner being characterized in that the medium-resistance external additive coating ratio of toner particles in a range in which mother particles have equivalent particle diameters larger than the roughness of the developing roller or than an equivalent particle diameter of a mother particle equal to the mean particle diameter of the toner is set to be higher than a virtual reference curve in synchronous distribution of the equivalent particle diameters of synchronous medium-resistance external additive particles relative to the equivalent particle diameters of mother particles, wherein assuming that the medium-resistance external additive coating ratio of a toner particle of which a mother particle has an equivalent particle diameter equal to the roughness of a developing roller or the mean particle diameter of the toner is a reference value, the virtual reference curve is obtained to satisfy that the medium-resistance external additive coating ratio is constant at the reference value.

6. A toner as claimed in claim 5, being characterized in that said reference value is in a range from 80% to 120%.

7. An image forming apparatus comprising a photoreceptor on which an electrostatic latent image is formed, a developing unit for developing the electrostatic latent image on the photoreceptor with a toner, a transfer means for transferring the developed image on the photoreceptor, and a fusing means for fusing the transferred image, the image forming apparatus being characterized that said toner is a toner as claimed in any one of claims 1 through 6.

8. A toner comprising:

first mother particles each having a first particle diameter equal to a mean particle diameter of the toner;

second mother particles each having a second particle diameter equal to a roughness of a developing roller;

third mother particles each having a third particle diameter which is smaller than the first or second particle diameter of each of the first or second mother particles; and medium-resistance external additive particles, wherein a medium-resistance external additive coating ratio of the third mother particles is set to be higher than a virtual reference curve, wherein the virtual reference curve is a synchronous distribution of particle diameters of the medium-resistance external additive particles relative to the first or second particle diameters of the first or second mother particles, wherein a reference value of the virtual curve is equal to a medium-resistance external additive coating ratio of (1) the second mother particles, or (2) the first mother particles, such that the virtual reference curve satisfies a condition that the medium-resistance external additive coating ratio is constant at the reference value.

9. A toner as claimed in claim 8, wherein said reference value is in a range from 80% to 120%.

10. A toner comprising:

first mother particles having first particle diameters which are equal to a mean particle diameter of the toner;

second mother particles having second particle diameters which are equal to a roughness of a developing roller;

third mother particles having third particle diameters which are smaller than the second particle diameters of the second mother particles;

fourth mother particles having fourth particle diameters which are larger than the first particle diameters of the first mother particles; and medium-resistance external additive particles, wherein, a medium-resistance external additive coating ratio of at least some of the third mother particles, and a medium-resistance external additive coating ratio of at least some of the fourth mother particles, are set to be higher than a virtual reference curve, wherein the virtual reference curve is a synchronous distribution of particle diameters of the medium-resistance external additive particles relative to a diameter between the first or second particle diameters of the first or second mother particles, wherein a reference value of the virtual curve is equal to a medium-resistance external additive coating ratio of a mother particle having a diameter between the second diameter and the first diameter, such that the virtual reference curve satisfies a condition that the medium-resistance external additive coating ratio is constant at the reference value.

11. A toner as claimed in claim 10, wherein said reference value is in a range from 80% to 120%.

12. A toner comprising:

first mother particles each having a first particle diameter equal to a mean particle diameter of the toner;

second mother particles each having a second particle diameter equal to a roughness of a developing roller;

third mother particles each having a third particle diameter which is larger than (1) the second particle diameter of each of the second mother particles, or (2) the first particle diameter of each of the first mother particles; and medium-resistance external additive particles, wherein a medium-resistance external additive coating ratio of at least some of the third mother particles is set to be higher than a virtual reference curve, wherein the virtual reference curve is a synchronous distribution of particle diameters of the medium-resistance external additive particles relative to the first or second particle diameters of the first or second mother particles, wherein a reference value of the virtual curve is equal to a medium-resistance external additive coating ratio of (1) the second mother particles, or (2) the first mother particles, such that the virtual reference curve satisfies a condition that the medium-resistance external additive coating ratio is constant at the reference value.

13. A toner as claimed in claim 12, wherein said reference value is in a range from 80% to 120%.

14. An image forming apparatus comprising:

a photoreceptor on which an electrostatic latent image is formed;

a developing unit for developing the electrostatic latent image on the photoreceptor with a toner;

a transfer means for transferring the developed image on the photoreceptor, wherein the toner is a toner as claimed in any one of claims 1 through 6.

* * * * *